US005744000A

United States Patent [19]

Athey et al.

[11] Patent Number: 5,744,000

[45] Date of Patent: Apr. 28, 1998

[54] METHOD FOR MAKING ENCODED FILAMENTS AND USE OF ENCODED FILAMENTS TO PRODUCE SECURITY PAPER

[76] Inventors: Graham Athey; James Zorab, both of Unit A13 Treforest Industrial Estate, Pontypridd Mid-Glamorgan, Great Britain

[21] Appl. No.: 619,620

[22] PCT Filed: Sep. 29, 1994

[86] PCT No.: PCT/GB94/02123

§ 371 Date: May 23, 1996

§ 102(e) Date: May 23, 1996

[87] PCT Pub. No.: WO95/09947

PCT Pub. Date: Apr. 13, 1995

[30] Foreign Application Priority Data

Oct. 2, 1993 [GB] United Kingdom ..... 9320365

[51] Int. Cl.[6] ..... D21H 13/10

[52] U.S. Cl. ..... 162/140; 162/103; 283/70; 283/72

[58] Field of Search ..... 283/70, 72, 85, 283/87, 91, 92, 93; 162/103, 134, 140; 427/7, 157

[56] References Cited

U.S. PATENT DOCUMENTS

| | | | |
|---|---|---|---|
| 4,761,205 | 8/1988 | Crane | 162/103 |
| 4,891,254 | 1/1990 | Bianco | 428/78 |
| 4,997,875 | 3/1991 | Geddes et al. | 524/504 |
| 5,239,902 | 8/1993 | Kaule | 83/13 |
| 5,573,639 | 11/1996 | Schmitz et al. | 162/140 |

FOREIGN PATENT DOCUMENTS

| | | | |
|---|---|---|---|
| B 1 585 533 | 7/1976 | United Kingdom | D12H 5/10 |
| 2180564 | 9/1985 | United Kingdom | D12H 5/10 |

*Primary Examiner*—Peter Chin
*Assistant Examiner*—Steven B. Leavitt
*Attorney, Agent, or Firm*—Rudnick & Wolfe

[57] ABSTRACT

The invention is concerned with the production of filaments or fibers each of which carries a recognizable "signature" (encoding). These filaments or fibers are produced by taking a film (preferably a plastics film) applying a code directly onto the film across the effective width of the film and then dividing the film substantially at right angles to the code into longitudinal filaments, so that the encoding is then present in each of the filament in exactly the same "signature" as in the code applied to the film.

18 Claims, 1 Drawing Sheet

METHOD FOR MAKING ENCODED FILAMENTS AND USE OF ENCODED FILAMENTS TO PRODUCE SECURITY PAPER

FIELD OF THE INVENTION

This invention relates to filaments or fibers which are treated to give them a recognisable "signature" (encoding) and more particularly, a signature which is machine-readable. The invention is realized in both the method of producing the filaments or fibers and in the filaments or fibers themselves.

SUMMARY OF THE INVENTION

Fibers having a machine-readable signature can be used, for example, to identify security papers, such as paper used for currency.

According to a first aspect of the invention, a method of manufacturing an encoded filament or fiber comprises: providing a film, applying a bar code directly onto the film across the effective width of the film, and then dividing the film substantially at right angles to the bar code into longitudinal filaments. It will be appreciated that it is not feasible to apply a bar code to a very narrow filament or fiber, but a bar code can be readily applied across the effective width of a film, and when the film is divided longitudinally, each of the strips or filaments so produced has the bar code applied to it. Even if the filaments are narrow enough to constitute fibers, each of those fibers will still carry the bar code, in very narrow form, and hence has the same "signature" or encoding as that applied to the film.

The film is preferably made of plastics material. Preferred materials include polyolefin, polyvinylchloride, polyester, polyamide, polyethersulphone, or polyetheretherketone (PEEK). A preferred polymer is polyolefin, especially a propylene polymer (which may be a homopolymer or an ethylene-propylene co-polymer with a minor proportion of ethylene). The polyolefin is preferably polypropylene with a melt flow index of approximately 8 to 10 grammes per ten minutes, according to ASTM D1238.

According to a preferred feature of the invention, the film is divided longitudinally by fibrillation. If relatively wide filaments (say, over 1 mm in width) are required, it might be possible to employ slitters, but where the requirement is for narrower filaments, which can properly be described as fibers, then slitters are not suitable, but fibrillation can be used.

The deformation in the fibrillation unit may be twisting (for example, as described in British Patent Specification 1 040 663) or surface striation (for example, as described in "Fibre Technology: From Film to Fibre" by Hans A. Krassig, published by Dekker (1984)). Such surface striation typically involves passing the film under tension against needles or pins provided on a rotating roller, to cause rupture of the film longitudinally (in the machine direction), but without lateral separation or splitting until after the film has passed downstream of the roller. Such fibrillation is well known for polymer films where the film is fed in a continuous production run from the extruder to the fibrillation unit and it is one of the perceived advantages of the fibrillation process that it can be operated as an integral part of a continuous operation.

The fibrillation process causes the film to break up into long parallel filaments. In practice these long filaments may be cut to a "staple" length longer than the bar code repeat. It will also be appreciated that the film can be fed continuously past a bar code applicator, the arrangement providing repeats of the bar code along the length of the film.

According to another preferred feature of the invention, the two colour effect required to produce the code bars and spaces is not readily visible to the naked eye. If the fibers produced by the invention are of small size, then the bar code will be difficult to detect with the naked eye in any event. (By way of illustration, 20 microns width will give a fiber approximately 5 decitex.) However, it is preferred that at least one of the two colours is outside the visible spectrum, and in the preferred method, the said one colour is fluorescent. In practice, it may only be necessary to apply one colour, since the other colour may be the natural colour of the film.

The use of encoding not visible to the naked eye is particularly advantageous in security paper, for example, because it ensures that the presence of the fiber cannot be detected without special reading equipment. However, whilst it is well known to incorporate a fluorescent filament in currency notes, so that the presence or absence of the filament can be recognised merely by irradiating the note with ultraviolet light, the present invention provides the additional advantage that significant data, such as alphanumeric data can be stored on the encoded fiber or filament.

It has also been found that the use of a fluorescent coding presents the advantage, additional to that of being invisible to the naked eye, that it produces a greater contrast with the natural colour of the film or any ordinary film colouring, than would be produced by an applied colour code in the visible spectrum. This enhanced contrast value occurs particularly if a laser type bar code reader capable of reading a bar code of very small width, such as that on a fiber, is employed.

According to a second aspect of the invention, an encoded fiber comprises a plastics fiber, to which has been applied a bar code, in which the bars are substantially at right angles to the length of the fiber. The fibers in accordance with this second aspect of the invention may be manufactured in accordance with any of the preferred features of the first aspect of the invention.

According to a third aspect of the invention, a security paper (which expression is intended to include currency paper) includes fibers made in accordance with the first aspect of the invention. Preferably the fibers are incorporated in the paper in a random fashion by blending them into an aqueous slurry during the paper making process. An advantage of this aspect of the invention is that not only is it possible to verify the legitimacy of the paper, it is also possible to encode alphanumeric data on the fibers and hence in the security paper.

It is a disadvantage of printing a bar code using the conventional black bars, that when the fiber is incorporated in say a paper, the bar print interferes with any other printing subsequently applied to the paper. However, the fluorescent coding is not subject to this disadvantage. The fluorescent bars have a higher profile over subsequent printed matter than ink printed bars.

BRIEF DESCRIPTION OF THE DRAWINGS

The invention will be better understood from the following description of one method of manufacturing encoded "signature" fibers and the production of security paper including the fibers, which is given here by way of example only, with reference to the accompanying drawings, in which.

DESCRIPTION OF THE PRESENT INVENTION

Figure 1:
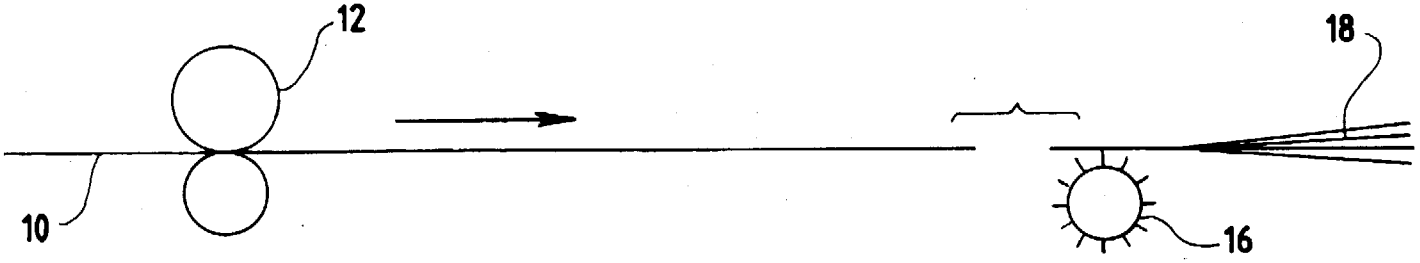
FIG. 1 is a diagrammatic elevation of the flow path of a continuous film.

In this specific example, signature fibers are to be used in the manufacture of security paper such as that used for currency. The starting material, however, is a film 10 of polypropylene with a melt flow index of approximately 2 to 10 grammes per ten minutes according to ASTM D123B. The polypropylene film is extruded through an oblong die (not shown) water quenched, and then stretched in the direction of the extrusion machine to a ratio of between 4:1 and 10:1 using hot ovens to soften the film during the process. The resulting film 10 can typically have a thickness of from 5 micrometers up to 100 micrometers, but in the specific example, the thickness of the film is about 25 micrometers. The film width defined between opposed and parallel edges 11 and 11' may be up to 2.2 meters.

The extrusion machine and hot ovens are not illustrated in the diagrammatic drawings, as these are conventional.

Figure 2:
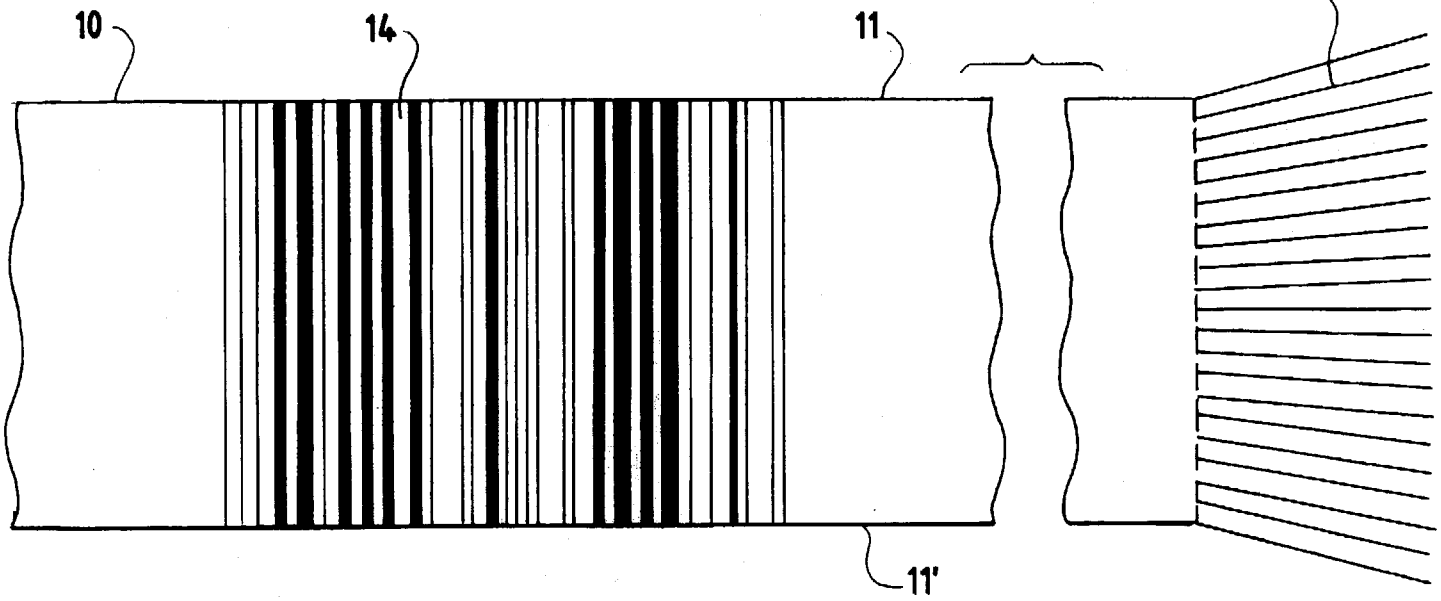
FIG. 2 is a plan view of the film shown in FIG. 1.

The film then passes a bar code applicator 12, which may for instance take the form of a drum or formed character printer, or an electrostatic printer. The printer 12 produces a bar code 14 on the top surface of the film 10, and as is illustrated in FIG. 2, the bars of the code extend across the full width of the film, that is to say the bars are at right angles to the length of the film and to the direction of motion of the film. The spaces between the bars are provided by the natural colour of the film 10, so that it is only necessary to apply the bars themselves. Although these bars have been clearly shown at 14 in FIG. 2, in order to illustrate the invention, in practice, the applicator 12 is arranged to apply the bars in the form of fluorescent paint, so that they would not be visible to the naked eye, unless eradiated with ultraviolet light.

Now, although to the naked eye there is no or no substantial contrast between the colouring of the spaces and the bars, certain types of machine reader are well adapted to read a bar code in which the bars are of fluorescent paint, and indeed in the case of a laser-type bar code reader, for instance, the contrast between the natural colouring of the film and fluorescent paint is higher than the contrast between the film colouring and ordinary visible ink. Thus, one of the advantages of using the fluorescent paint is that it gives this higher contrast for machine reading.

Beyond the position of the applicator, the film passes over a pinned fibrillation drum 16, the pins of which engage with the undersurface of the film 10 and cause the film to be striated but not split. Downstream of the fibrillation roller 16, the film passes a stretch breaking station (not shown), at which the film divides into individual fibres indicated diagrammatically at 18. These fibres form a tow, which can be collected in a can coiler (not shown). It will be appreciated that the fibrils produced by this method have essentially parallel faces, formed out of the top and bottom surfaces of the original film, and in this respect, they differ from circular cross-section fibres conventionally used in the textile industry.

From the can coiler, the filamentary tow can be taken to textile opening machinery, such as a carding machine, which will produce further fibrillation, thus reducing the cross-sectional dimensions of the fibrils, and will also result in stapling the fibers. However, the tow could be subjected to a stapling operation as an alternative to or prior to the textile opening process.

Each of the fibers will carry the bar code, because the fibers extend generally lengthwise of the film to which the bar code is applied. Of course, since the fibers are of very small width, the "bars" are virtually reduced to dots, but the width of the "bars" will be retained in the fibers, and hence the encoding will be similarly retained. It is, of course, necessary to read this coding on a machine which is adapted to read off a very short "length" bar code. It is also important that the stapling process should be such that over the great majority of the stapled fibers, at least one repeat of the entire bar code is present.

In the manufacture of security paper or currency paper, fibers produced as described above are introduced into the aqueous slurry during the paper making process. The encoded fibers may constitute 1% or less of the fibrous material included in the slurry, and as a result of the mixing into the slurry, the fibers are in a random but relatively homogenous distribution throughout the paper which is produced from the slurry in a conventional paper making machine. It will be appreciated that since the bars of the code are formed of fluorescent paint, they are not visible in the security paper. Hence, by ordinary visual inspection, it is not possible to detect their presence. However, if the paper is passed under ultraviolet light, the bar coded filaments will radiate the light, and their presence will be apparent. This provides the ordinary security effect. Beyond that, however, if the paper is passed under a bar code reader of a type which is adapted to read very short bar lengths, then the code can be read off from any of the randomly arranged fibers which extends predominantly in a longitudinal direction. Hence, alphanumeric data incorporated in the bar code can be read off from the security paper itself.

What is claimed is:

1. A method of manufacturing an encoded filament or fiber comprising the steps of: applying a bar code directly onto a length of film the bar code being readable by scanning the length of the film longitudinally, and then dividing such that each filament or fiber produced is encoded with the same bar code, independent of the filament or fiber width.

2. A method of manufacturing an encoded filament or fiber as claimed in claim 1, in which the film is made of plastics material.

3. A method of manufacturing an encoded filament or fiber as claimed in claim 2, in which the film is made of one of: polyolefin, polyvinylchloride, polyester, polyamide, polyethersulphone, or polyetheretherketone (PEEK).

4. A method of manufacturing an encoded filament or fiber as claimed in claim 3, in which the polyolefin film is a propylene polymer.

5. A method of manufacturing an encoded filament or fibre as claimed in claim 4, in which the propylene polymer is a homopolymer or an ethylene-propylene co-polymer with a minor proportion of ethylene.

6. The method of manufacturing an encoded filament or fiber as claimed in claim 4, in which the polymer is polypropylene with a melt flow index of approximately 2 to 10 grams per ten minutes, according to ASTM D1238.

7. The method of manufacturing an encoded filament or fiber as defined in any one of claims 1 to 6, wherein the step of dividing the film longitudinally is effected through random fibrillation of the film.

8. The method of manufacturing an encoded filament or fiber as defined in claim 7, in which fibrillation of the film comprises twisting.

9. The method of manufacturing an encoded filament or fiber as defined in claim 7, in which the fibrillation of the film comprises surface striation.

10. The method of manufacturing an encoded filament or fiber as defined in claim 9, in which the surface striation comprises passing the film under tension against needles or pins provided on a rotating roller, to cause rupture of the film longitudinally (in the machine direction), but without splitting until after the film has passed downstream of the roller.

11. The method of manufacturing an encoded filament or fiber as defined in claim 10, in which the surface striation comprises passing the film under tension against needles or pins provided on a rotating roller, to cause rupture of the film longitudinally (in the machine direction), but without lateral separation until after the film has passed downstream of the roller.

12. The method of manufacturing an encoded filament or fiber as defined in claim 1, in which said bar code comprises a bar repeat code.

13. The method of manufacturing an encoded filament or fiber as defined in claim 12, in which longer filaments produced by dividing the width of said length of film are cut to a length longer than said bar code repeat.

14. The method of manufacturing an encoded filament or fiber as defined in claim 1, wherein the bar code directly applied to said film has a different color from that of the film.

15. The method of manufacturing an encoded filament or fiber as defined in claim 14, in which said bar code is not readily visible to the naked eye.

16. The method of manufacturing an encoded filament or fiber as defined in claim 14 in which the color of the bar code or the film is outside the visible spectrum.

17. The method of manufacturing an encoded filament or fiber as defined in claim 16, in which the color of the bar code or film is florescent.

18. A security paper including fibers or filaments made by the steps of: applying a bar code directly onto a length of film, the bar code being readable by scanning the length of film longitudinally, and then dividing the width of the length of film at right angles to the bar code into longitudinal filaments or fibers such that each filament or fiber produced is encoded with the same bar code, independent of the filament or fiber width; wherein the fibers or filaments are incorporated in the security paper in a random fashion by blending them into an aqueous slurry during a security paper making process.

* * * * *